US007442088B2

(12) United States Patent
Looney et al.

(10) Patent No.: US 7,442,088 B2
(45) Date of Patent: Oct. 28, 2008

(54) METHODS AND APPARATUS FOR THE PREVENTION OF INCORRECT CARD INSERTION

(75) Inventors: Lyle S. Looney, Livermore, CA (US); Alvan R. Tom, Los Altos, CA (US); James G. Arthur, Morgan Hill, CA (US)

(73) Assignee: Tellabs San Jôse, Inc., San Jose, CA (US)

( * ) Notice: Subject to any disclaimer, the term of this patent is extended or adjusted under 35 U.S.C. 154(b) by 0 days.

(21) Appl. No.: 11/264,804

(22) Filed: Nov. 1, 2005

(65) Prior Publication Data

US 2006/0286869 A1 Dec. 21, 2006

Related U.S. Application Data

(60) Provisional application No. 60/686,998, filed on Jun. 4, 2005.

(51) Int. Cl.
*H01R 24/00* (2006.01)

(52) U.S. Cl. ..... 439/633

(58) Field of Classification Search ..... 439/633, 439/637, 677, 680, 681
See application file for complete search history.

(56) References Cited

U.S. PATENT DOCUMENTS

| | | | | | |
|---|---|---|---|---|---|
| 2,925,537 | A * | 2/1960 | Winkler | 361/790 |
| 2,935,725 | A * | 5/1960 | Fox | 439/633 |
| 2,968,019 | A * | 1/1961 | Steinman et al. | 439/633 |
| 3,364,458 | A * | 1/1968 | Black, Jr. et al. | 439/680 |
| 3,533,045 | A * | 10/1970 | Henschen | 439/62 |
| 4,853,830 | A * | 8/1989 | Corfits et al. | 361/725 |
| 5,273,463 | A * | 12/1993 | Kaetsu et al. | 439/681 |
| 5,387,132 | A * | 2/1995 | Sarver et al. | 439/633 |
| 5,398,161 | A * | 3/1995 | Roy | 361/727 |
| 5,421,734 | A * | 6/1995 | MacWilliams | 439/59 |
| 5,688,147 | A * | 11/1997 | Coteus et al. | 439/681 |
| 6,315,614 | B1 | 11/2001 | Hassanzadeh et al. | |
| 6,421,252 | B1 * | 7/2002 | White et al. | 361/797 |
| 6,428,360 | B2 | 8/2002 | Hassanzadeh et al. | |
| 6,466,044 | B1 * | 10/2002 | Smith | 324/755 |
| 6,520,805 | B2 | 2/2003 | Hassanzadeh et al. | |
| 6,814,583 | B1 * | 11/2004 | Young et al. | 439/65 |
| 6,822,874 | B1 * | 11/2004 | Marler | 361/752 |
| 6,921,296 | B2 | 7/2005 | Lecinski et al. | |
| 7,079,381 | B2 * | 7/2006 | Brehm et al. | 361/685 |
| 2001/0007803 | A1 * | 7/2001 | Wilson | 439/633 |

* cited by examiner

*Primary Examiner*—Tulsidas C. Patel
*Assistant Examiner*—Vladimir Imas
(74) *Attorney, Agent, or Firm*—Hamilton, Brook, Smith & Reynolds, P.C.

(57) ABSTRACT

A system or method ensures proper insertion of a circuit board ("card") assembly into a card support assembly. A card assembly includes a first keying feature other than on a face-plate connected to the card assembly. The keying feature may be a notch, tab or slot, and the keying feature may be integral with the card assembly. The card support assembly includes a second keying feature that corresponds to the first keying feature. The second keying feature is positioned so as to allow cards with the correct keying feature to connect with the support assembly and to prevent cards that lack the keying feature, or are misaligned, from contacting the connectors of the support assembly. As a result, an effective keying solution is provided for the card assembly, and damage to circuit boards and connectors caused by improper connections is prevented without costly manufacturing processes.

22 Claims, 6 Drawing Sheets

METHODS AND APPARATUS FOR THE PREVENTION OF INCORRECT CARD INSERTION

RELATED APPLICATION(S)

This application claims the benefit of U.S. Provisional Application No. 60/686,998, filed on Jun. 4, 2005. The entire teachings of the above application are incorporated herein by reference.

BACKGROUND OF THE INVENTION

Communications systems are typically modular in design, made of various communications modules that include hardware and software that transmit inter-module communications signals, such as data or clock signals, in order to support communications traffic running through the communications system. In such a communications system, several communications modules may connect to a chassis through which the modules send communications signals to one another. The chassis may include a backplane with a number of socket-type connectors, and the modules may include pin-type card connector(s). The card connector(s), if compatible with the chassis backplane connectors, mate with the backplane connectors, thereby connecting to the chassis backplane and completing a communications path to other modules.

Often, a communications system supports a number of different modules that connect to the backplane. However, a particular backplane connector may not be compatible with a particular module's card connector(s). If such a connection is made without regard to connector compatibility, an incorrect connection may result, possibly preventing desired communications or even damaging the system. Moreover, a module intended to connect to the correct backplane connector may be oriented incorrectly, causing an improper connection, no connection, or damage to the connectors. In these and other cases when incorrect connections may occur, it is preferable to prevent incorrect connections.

SUMMARY OF THE INVENTION

Embodiments of the present invention provide a system and method of ensuring proper insertion of circuit boards, communication modules, or other communication systems elements into a support assembly, such as a card cage or other chassis. In one embodiment of the present invention, a circuit board assembly includes a first keying feature located on the circuit board assembly at a location other than on a faceplate coupled to the circuit board assembly. The first keying feature may be integral with or coupled to a circuit board assembly notch, tab, or slot and the circuit board assembly may include at least one first component of a first connector assembly (e.g., pin-type connector). In this embodiment, the support assembly comprises a second keying feature and a second component of the connector assembly (e.g., socket-type connector), where the second component of the connector assembly may be located on a backplane in the support assembly. The second keying feature is positioned in a manner allowing circuit board assemblies with the correct keying feature to have the first component of the connector assembly connect with the second component of the connector assembly. The second keying feature prevents contact between the first connector component and the second component in cases where the circuit board assemblies lack the first keying feature or have the first keying feature misaligned from the second keying feature. As a result, embodiments of the present invention provide a cost-effective keying solution that prevents damage to circuit connectors and can be manufactured with relative ease.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Embodiments of the present invention determine and prevent incorrect card insertions prior to making connector component contact. Example embodiments are presented below in reference to FIGS. 1-4D. Based on the embodiments, cost savings of materials can be realized, and damage to connectors in the field may be reduced.

Figure 1:
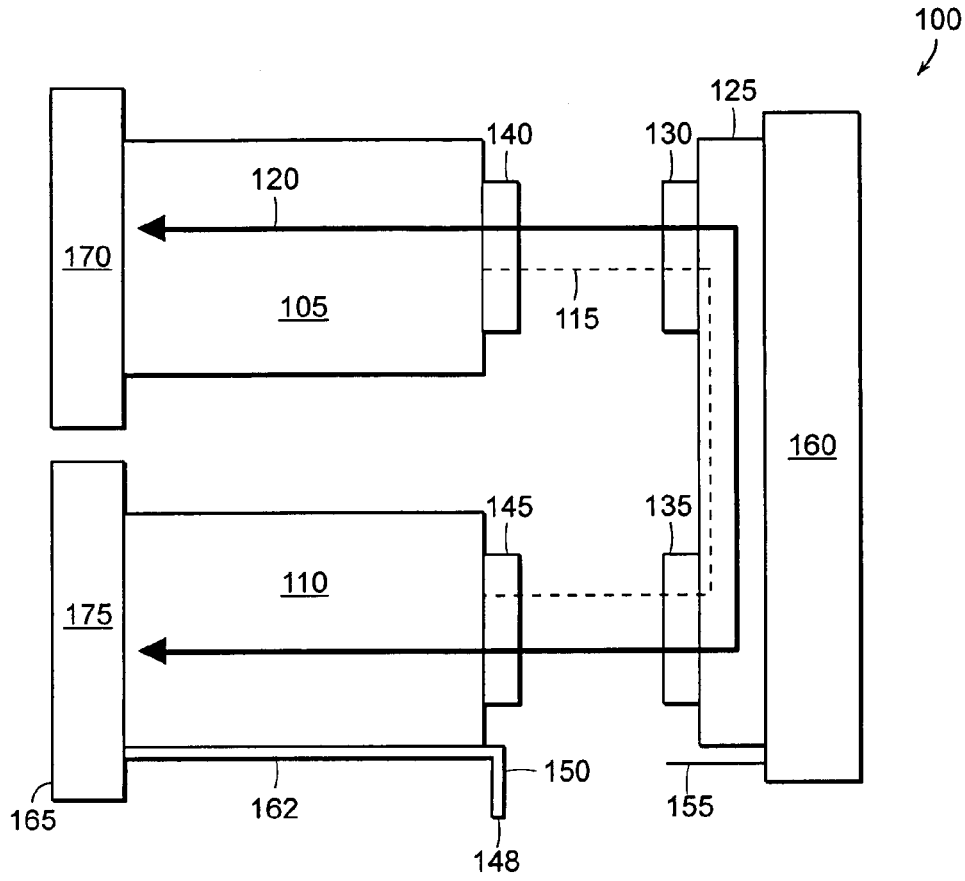
FIG. 1 is an illustration of a subassembly in which an embodiment of the present invention can be employed.

FIG. 1 is a mechanical diagram of a subsystem 100 in a communications system. The subsystem 100 includes communications modules 105, 110 (also referred to herein as "cards") that connect to a multiple card-holding structure 160 (hereinafter referred to as a "chassis"). Within the chassis 160 is typically another card, a backplane 125, which may use socket-type connector components also referred to herein as "sockets," 130, 135 for receiving the cards 105, 110. At the edge of each card 105, 110 is a card connector component 140, 145, respectively, which are pin-type connector components in cases the backplane connectors are socket-type connector components and which may or may not mate with particular backplane connector components 130, 135.

Upon mating of connector components 130/140 and 135/145, circuit board traces connected to the connector components permit communications between the card 105, 110 and the backplane 125. Because other communications modules can similarly connect to the backplane 125, the backplane 125 provides a mechanism supporting communications between or among two or more cards. A dashed line 115 illustrates such inter-card communications passing through the cards 105, 110 and backplane 125. A solid line 120 illustrates communications traffic running through the system. For simplicity, connector components may be referred to herein as simply "connectors," and it should be understood that pin—or socket-type connectors may be located on circuit board assemblies or on backplanes 125 in any combination.

The cards 105, 110 of FIG. 1 may include a card tray 162, which is illustrated as attached to one of the cards 110. The card tray 162 may be aluminum or other material that may be attached to the cards 105, 110 for handling, structural, thermal control, or other purposes.

In a prior art system, the card tray 162 includes a flange or bend 148 that has a small hole 150 at a particular location. The hole 150 mates with a narrow pin 155 located within the chassis 160 for purposes of aligning the circuit board 110 to align pins (or sockets) in the connector 145 with their counterparts in the backplane connector 135. Only a card having a hole 150 at the location that is of a particular size and shape so as to mate with the pin 155 can be inserted and mated with the socket 135. The card 110 must also be oriented so that the pin 155 and hole 150 are aligned, ensuring that the traces of each mating edge are also correctly aligned. Because this method includes a small hole 150 and pin 155, it calls for precise manufacturing tolerances, which may be costly or difficult to achieve. Moreover, cards 105 not equipped with a flange or bend 148 are susceptible to damage since the connectors 140, 135 can contact each other, and cards 110 with the flange 148 may experience damage of the connector 145, or electrical to electrical components on the cards 110, if orientation between the flange 148 and connector 145 is improperly offset.

In other prior art systems, the connectors 130, 135 and 140, 145 have been configured with built-in alignment or keying features to protect against misaligned insertion or connection of incompatible circuit boards. Adding keying features to connectors with tight tolerances can be expensive and difficult to implement.

Alternatively, in other prior art systems, a protruding part with a complex shape, such as an "R" or crescent shape, and a similarly-shaped hole is used in place of the pin 155 and hole 150. Such solutions may also require precise manufacturing. Yet another prior art technique locates a hole at location 165 on a card faceplate 175 mechanically connected to the card 110. In addition to requiring precise manufacturing and costly customization and configuration efforts on the part of a faceplate manufacturer, system designer, and system integration personnel, this method may not be aesthetically pleasing because it prevents a streamlined look for the faceplate.

Embodiments of the present invention improve upon existing methods by implementing a low-cost and efficient keying arrangement to prevent incorrect card insertion into the chassis 160. Such embodiments may be created from simple, two- or three-dimensional shapes that are easily manufactured as part of a card assembly and card chassis, and do not require complex shapes as found in some faceplate keying systems or precise tolerances as required by other keying systems.

Figure 2A:
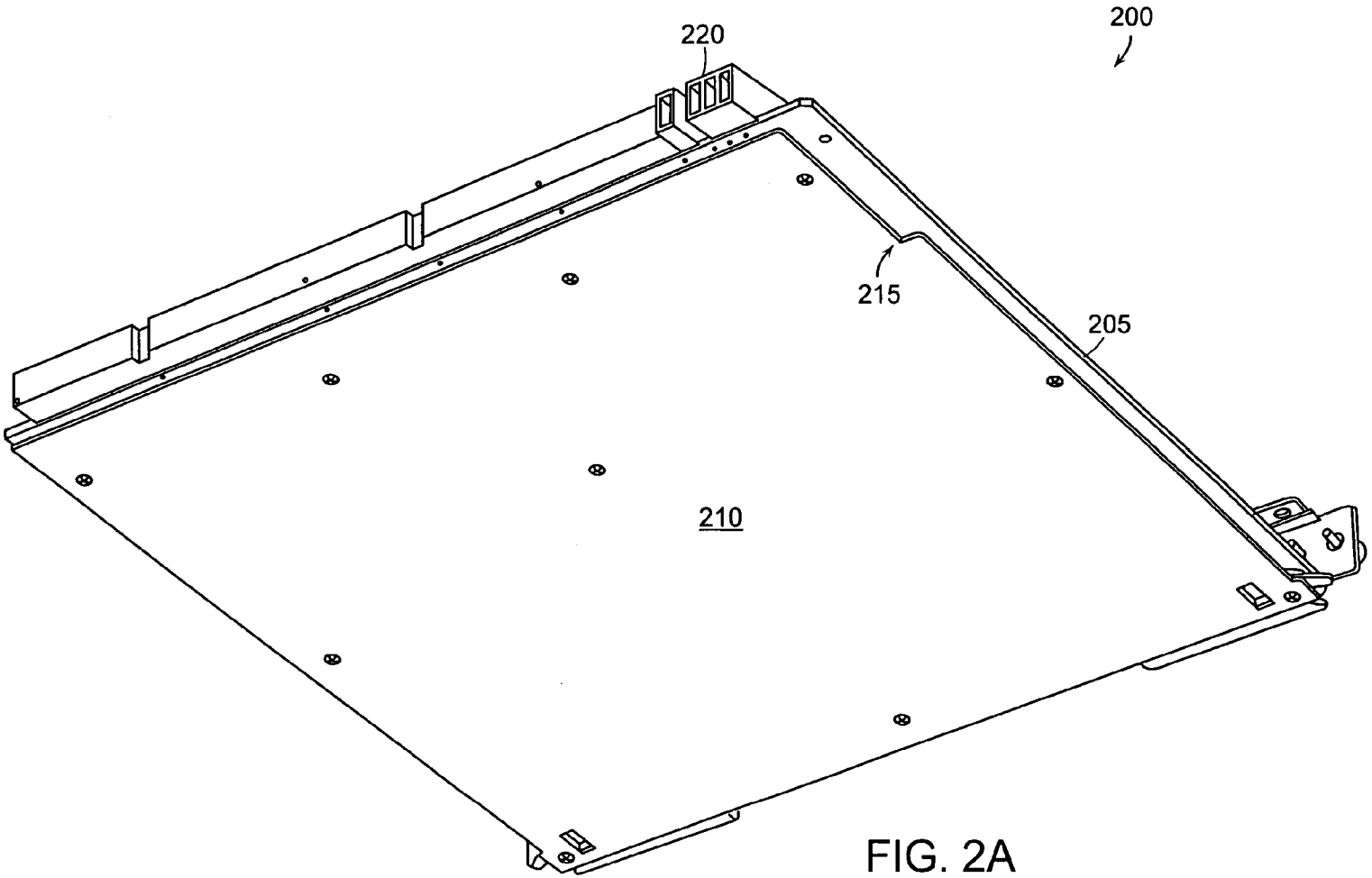
FIG. 2A illustrates a circuit board ("card") assembly according to an exemplary embodiment of the present invention.

FIG. 2A illustrates a circuit board ("card") assembly 200 of an exemplary embodiment of the present invention implementing a keying arrangement of a notch and tab. The card assembly 200 as depicted includes a card 205 (i.e., a circuit board with electrical or non-electrical components), and a card tray 210, (e.g., an aluminum sheet matching the shape of the card), and a card edge connector 210. In this embodiment, the card tray 210 has a notch 215 on one edge of the tray, which serves as a keying feature of the card assembly.

Figure 2B:
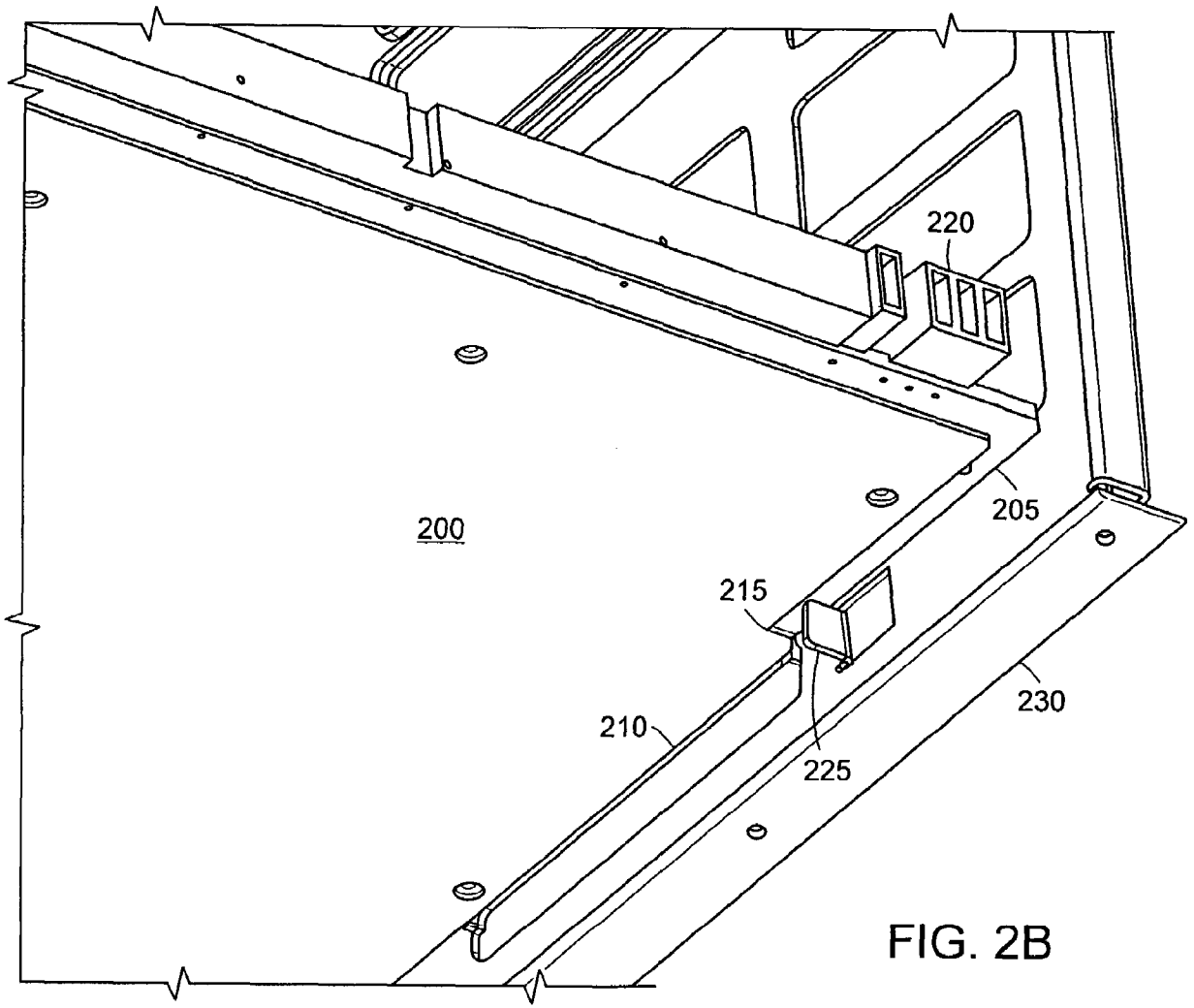
FIG. 2B illustrates a card assembly inserted into a card support assembly according to an exemplary embodiment of the present invention.

FIG. 2B illustrates a card assembly 200 inserted into a support assembly 230. The support assembly (herein referred to as "chassis") 320 may include a card cage, card connectors, card sockets, backplane, midplane, or other components facilitating a connection of the card assembly 200 with other circuitry. In this embodiment, the chassis 230 has a tab 225 that is perforated into an element of the chassis and bent to protrude from the rest of the chassis 230 into a path of a card assembly enroute to the backplane. Other techniques of adding the tab 225 may be employed, such as connecting a tab 225 via screws, epoxy, etc., inserting it into a slot, molding it, and so forth.

When the card assembly 200 is inserted into the chassis 230, the notch 215 in the card tray 210 "mates" with the tab 225 by "clearing" it (i.e., the notch 215 allows the card assembly 200 to slide past the tab 225). The notch 215 and tab 225 thus function as corresponding keying features and are shaped and positioned so as to allow the card assembly 200 to slide into the chassis 230 without collision between the notch 215 and tab 225. After the notch 215 clears the tab 225, the card assembly 200 can be inserted further into the chassis 230 so that the card connector 220 (i.e., connector component) can mate with a backplane socket (not shown) or other connector (i.e., connector component) in the chassis 230.

In this embodiment, the keying feature (i.e., notch 215) on the card assembly 200 may be located on either the right edge (as shown) or left edge of the card tray 210. These two edges may be adjacent to both the connecting edge 220 and the faceplate (not shown), or may correspond to opposite sides of the chassis where keying features may be located in this embodiment. Thus, a system may implement the keying features 215, 225 for multiple different types of cards and connector assemblies.

An example of another embodiment may be as follows: a card chassis may have sockets of type X, Y, and Z, where card assemblies of type A may connect with sockets of type X, card assemblies of type B may connect with sockets of type Y, and cards of type C may connect only with sockets of type Z. To ensure that no card assemblies connect with or contact incorrect sockets, the cards and chassis may have keying features in the following arrangement: A and X have a notch and tab on the left edge, B and Y have a notch and tab on the right edge, and C and Z have no notches or tabs. As a result, the keying features prevent several different card assemblies from making incorrect connections to the chassis. Moreover, only one type of card assembly may connect to sockets X and Y, and, because the chassis has no notches in front of Z, any card may connect to socket Z. This feature may be useful when a socket is compatible to connect to more than one different card assembly or when a card assembly is compatible to connect to more than one different socket.

The embodiment of FIG. 2B may be modified in a number of ways, allowing for the same or similar keying functionality. For example, the circuit board 205 may comprise a keying feature, rather than the card tray 210, by shaping the circuit board 205 to have a notch similar to notch 215. Alternatively, tabs may be used in place of notches on the circuit card or tray, and notches may be used in place of tabs on the chassis. Other keying features, such as slots and corresponding protrusions, may be used in place of the notches and tabs. Such a slot may be a hole of any shape and length, so long as a corresponding protrusion is positioned in the hole when a proper connection is made and blocks improper connections, as described above.

Further, keying features need not be located on the edges of each card or card tray; for example, keying features may be positioned on a face of a card or card tray and aligned to features on a corresponding wall or element of the chassis. By aligning the notches and tabs or other keying features parallel or perpendicular to one another, several unique keys can be created for different types of card assemblies. The keying features can be oriented in any direction with respect to one another, so long as the features contact to prevent incorrect card insertion.

Continuing to refer to FIG. 2B, the keying features of the card assembly 200 (notch 215) and the chassis 230 (tab 225) may be located at an edge other than the mating edge where card connector 220 is located. A keying feature may also be located at this mating edge by, for example, shaping a notch in the circuit board 205 or card tray 210 at this edge, and forming a tab in the chassis that fits inside this notch when the card assembly 200 is fully inserted into the chassis 230. In this and other embodiments, the keying feature on the chassis need not be located on the chassis wall, as shown in FIG. 2B, but may be located at any part of the chassis where it may connect with a corresponding keying feature of a card assembly. For example, a tab may be located on a card guide (not shown) within the chassis 230, or at any other member of the chassis that is in close proximity to a keying feature on the card assembly 200.

Figure 3:
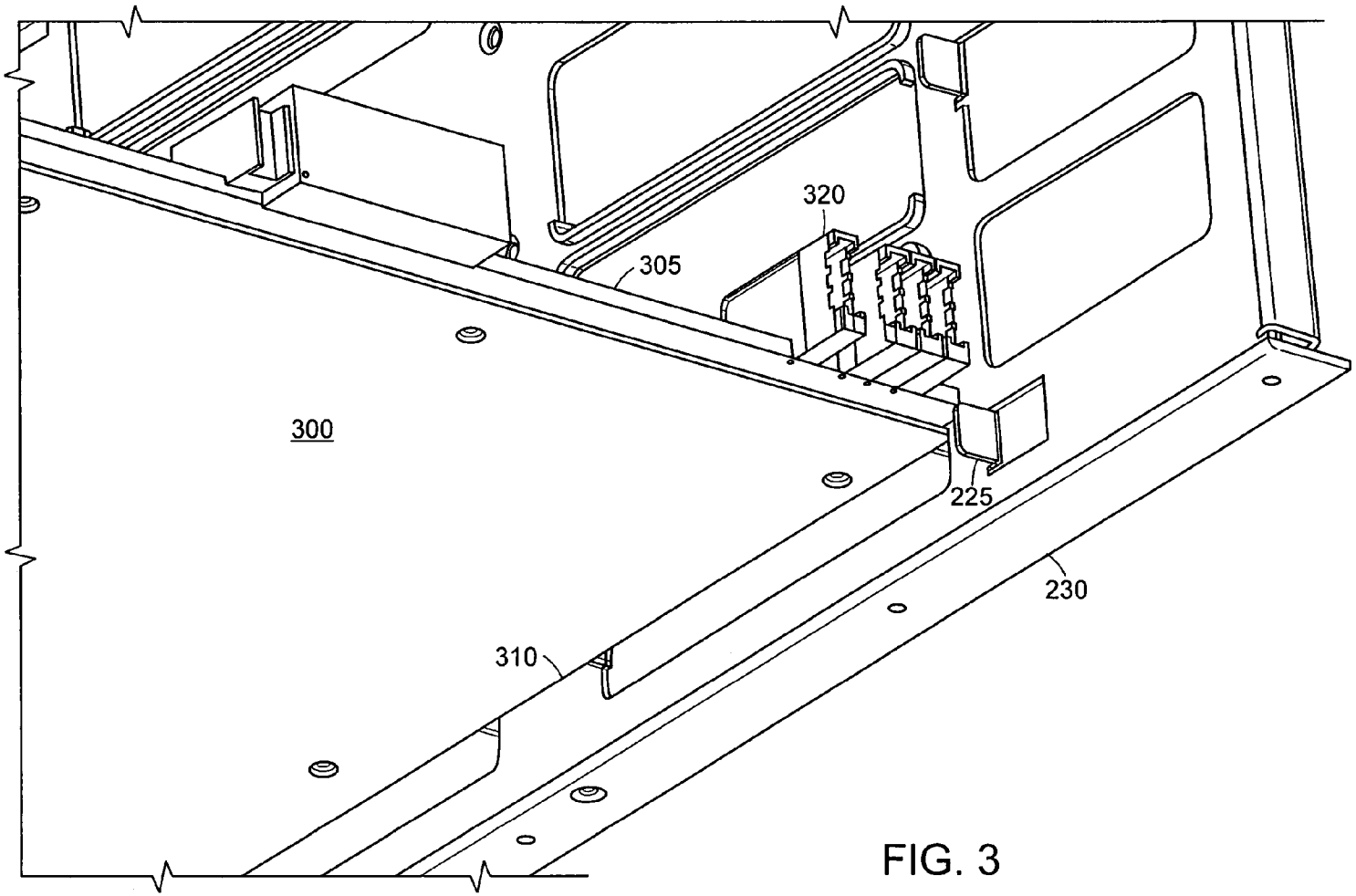
FIG. 3 illustrates a card with an incorrect keying feature prevented from insertion into a card support assembly according to an embodiment of the present invention.

FIG. 3 illustrates how an exemplary embodiment of the present invention may prevent a card without the correct keying features from being fully inserted into a chassis. In this embodiment, a card assembly 300 includes a card 305, card tray 310, and card edge connector 320, as does the card assembly 200 of FIG. 2B. However, the card assembly 300 of FIG. 3 illustrates a case in which the card tray 310 does not have a notch. Meaning the card assembly 300 is not intended to be inserted into the chassis 230, either because the card 305 is not compatible, because it is an older version, or any other reason. Because the card tray 310 does not have a notch, it does not clear the tab 225 when the card assembly 300 is inserted into the chassis 230. As a result, the tab 225 prevents the card assembly 305, which lacks the tab or keying feature, from being inserted farther into chassis 230. Thus, the card edge connector 320 or other type of connector is prevented from mating with a backplane socket (not shown) in the chassis 230, thereby preventing damage to connector components 320 on the card assembly 300 or the chassis 230.

Furthermore, this exemplary embodiment may also prevent insertion of a card assembly that has the correct keying feature, as does assembly 200 of FIG. 2A or 2B, but is not correctly oriented for connection with the chassis. For example, in reference to FIG. 3, the card assembly 300 may be inserted with the notch aligned in the chassis 230 at the wall opposite the tab 225. Such an alignment does not allow the card edge connector 320 to mate correctly to a connector in the chassis, and, without keying features, may result in an improper connection or damage to the connectors or circuitry. However, the tab 225 makes contact with an edge of the card assembly 300 lacking a notch, thereby preventing it from mating with the chassis. As a result, the connecting edges or connector components of incompatible cards and chassis are prevented from physically contacting each other, thereby preventing damage to the card assemblies and chassis.

Figure 4:
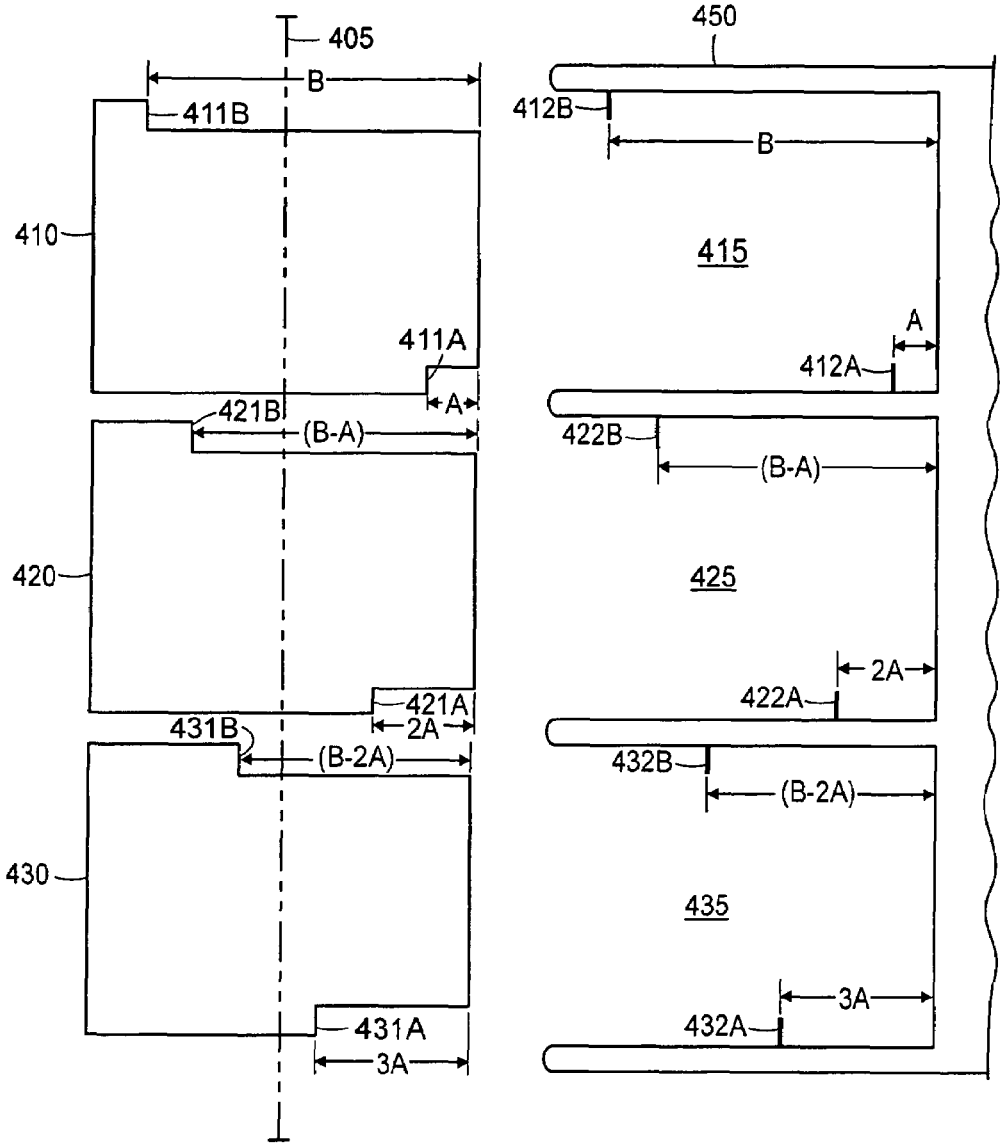
FIG. 4 illustrates an alternative embodiment of the present invention that provides keying for several different types of card assemblies.

FIG. 4 illustrates an alternative embodiment of the present invention, employing a combination of different tab and notch locations to create several different keying features for use in the same system. Card trays 410, 420, 430 are each keyed for insertion into only one slot 415, 425, 435, respectively, of the card chassis 450. Keying features are created through a number of notches 411*a/b*, 421*a/b*, 431*a/b* and respective tabs 412*a/b*, 422*a/b*, 432*a/b* that are located to ensure that only a card that is both inserted into the proper slot and correctly aligned can be fully inserted into a slot.

To accomplish this keying, notches must be placed so that each unique card tray has notches at different locations, and the notches on both sides of one card cannot be longer than the notches on both sides of a different card. If the construction of the chassis allows for cards to be inserted inversely, where the keying features can be positioned next to an opposite wall, then each card or card tray is preferably keyed so that the notches of each card or card tray do not match notches of the opposite sides of a different card or card tray. FIG. 4 shows a two-dimensional depiction of this embodiment for the purpose of illustrating the location of keying features and is not intended to be instructive to the general structure of card trays or chassis.

The keying features shown in FIG. 4 incorporate the aforementioned criteria. In this embodiment, the following exemplary design rules are applied: 1) notches on one side must be longer than the mid-length 405 of the card tray; 2) notches on the opposite side must be shorter than the mid-length 405; 3) all notch lengths must be different among all different cards; and 4) any card with a notch length longer than that of another card must have an opposite notch length that is shorter than the opposite notch length of the other card. In applying these rules, length B is designated as a standard notch length on the top side of each card tray, and length A is designated as a standard notch length on the bottom side of each card tray. Length A also serves as an increment of different notch lengths.

Notches 411*a*, 421*a*, 431*a*, located on the bottom edge of each card tray, are of lengths that are multiples of length A (e.g., A, 2A, 3A), and none is longer than the mid-length 405. Tabs 412*a*, 422*a*, 432*a* are located at distances from the back wall of the chassis 450 that correspond to the length of each notch, respectively. Notches 411*b*, 421 *b*, 431*b*, on the top side of each card tray, begin at length B (card tray 410) and decrease in increments of length A (B, B-A, B-2A), and all lengths are longer than the mid-length 405. Tabs 412*b*, 422*b*, 432*b* are located at distances from the back wall of the chassis 450 that correspond to the length of each notch, respectively. The mid-length 405 may be designated at any length along the card trays, so long as this length is uniform among the card trays and the aforementioned criteria are met.

With the notches and tabs positioned as specified, each card tray 410, 420, 430 may be fully inserted into only one slot 415, 425, 435, respectively, the tabs of which match the notches of the particular card or card tray. For example, the first card tray 410, with tabs 411*a/b* of lengths A and B, may only fit into the first slot 415, with notches of lengths A and B. If the first card tray 410 is inserted into the second slot 425, a tab 422*a* collides with notch 411*a*, preventing the first card tray 410 from being fully inserted. Likewise, if the second card tray 420 is inserted into the first slot 415*a*, a tab 412*b* collides with a notch 421*b*, preventing the second card tray 420 from being fully inserted.

When this embodiment is implemented, circuit boards (not shown) may be mounted to each card tray 410, 420, 430, with connecting edge aligned at the front edge of each tray. When inserted into the chassis 450, these circuit boards may connect with sockets (not shown) located on a backplane (not shown) at the back wall of the chassis 450. As a result, this embodiment of the present invention prevents cards mounted to a card tray from connecting with an incorrect socket, ensuring that each card connects only to a correct socket. Moreover, this embodiment allows the creation of multiple unique keys at a low cost to ensure the proper insertion and alignment of several different card assemblies into their respective slots.

As described above regarding other embodiments, the embodiment of FIG. 4 may be modified in a number of ways, allowing for the same or similar keying functionality. For example, tabs may be used in place of notches, and notches may be used in place of tabs. Other keying features, such as slots and corresponding protrusions, may be used in place of the notches and tabs. Keying features need not be located on the edges of each card or card tray; for example, keying features may be positioned on a face of a card or card tray and aligned to features on a corresponding wall of the chassis. Alternatively, keying features may be included in a circuit board rather than a card tray, such as by shaping a circuit board to have notches similar to the card trays shown in FIG. 4. Further, tabs on the chassis may be positionally aligned with elements known to be on a card which is intended to be prevented from inserting into a slot. For example, a tab may be positionally aligned with a power converter that can handle effects of a contacting a tab during insertion, where the "notch" is the difference between circuit boards intended to fit in a slot with the tab, that do not have a power converter and circuit boards prevented from fitting in the slot that do have a power converter.

Figure 5:
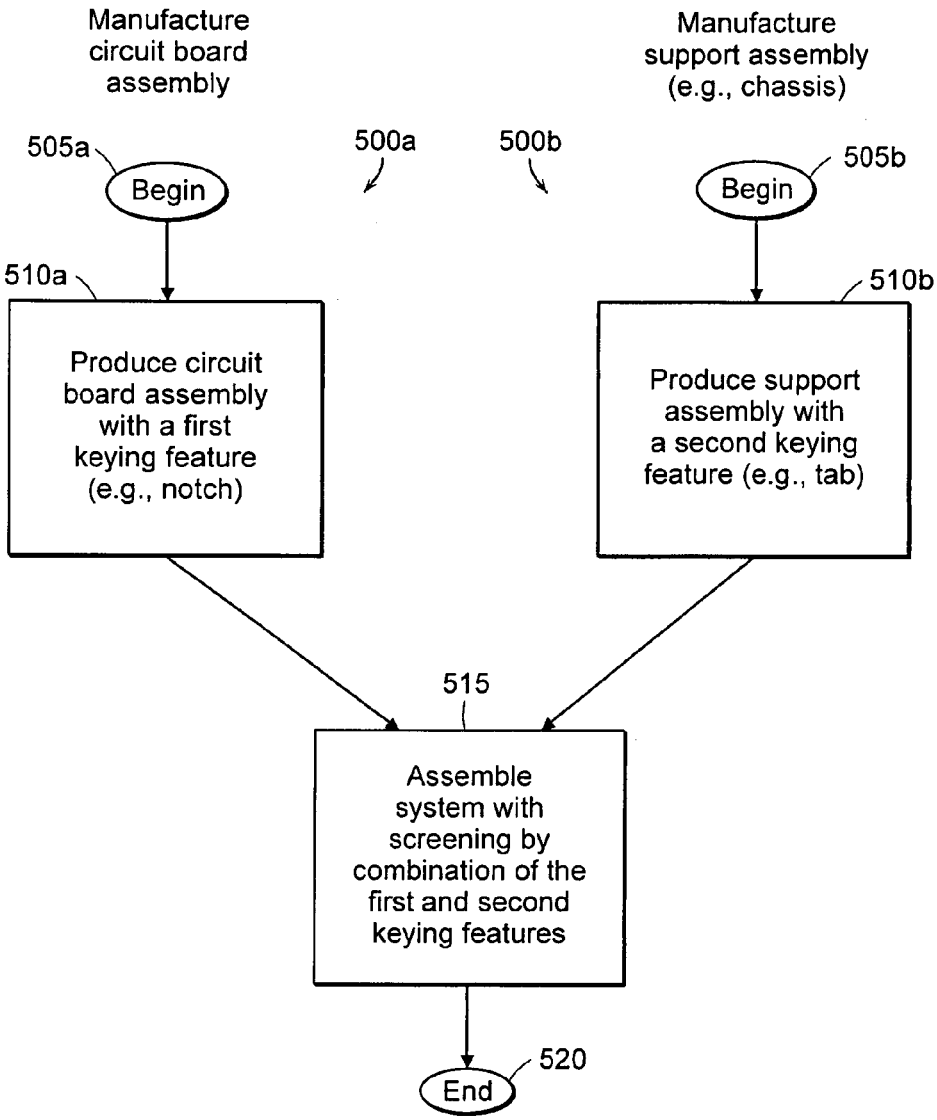
FIG. 5 is a flow diagram describing a manufacturing process for a system that employs the keying features according to embodiments of the present invention.

FIG. 5 is a flow diagram of manufacturing processes 500*a* and 500*b* in which circuit board assemblies and support assemblies are constructed in a manner consistent with embodiments of the present invention, as described above. The circuit board manufacturing assembly process 500*a* begins (step 505*a*) by a manufacturer of circuit boards or circuit board trays, which are connected to the circuit boards, as described above, in which a first keying feature, such as a notch, is applied to the circuit board assembly (step 510*a*). Examples of applying the first keying feature may be any of those described above, such as manufacturing a circuit board with a specific shape (e.g., notch) defining the first keying feature, applying the first keying feature to the circuit board following manufacturing of the circuit board, such as breaking-off a perforated section of the circuit board to form a notch, coupling a first keying feature (e.g., tab) to the circuit board assembly, and so forth.

At the same time as the manufacturing of the circuit board assembly, a support assembly manufacturing process 500*b* may be performed. Alternatively the support assembly may be manufactured at a different time. Either way, the support assembly manufacturing process 500*b* begins (step 505*b*) by a manufacturer who makes components or assembles a support assembly for the circuit boards. The support assembly manufacturer produces the support assembly with a second keying feature (e.g., a tab) (step 510*b*). Any of the example techniques for applying the second keying feature to the support assembly described above may be performed in this step (510*b*).

A support assembly configured to receive the circuit board assembly and including (i) a second component of the connector assembly and (ii) a second keying feature coupled to the support assembly at a location offset in a direction relative to the second component toward the first component as the first component travels toward the second component to mate with the second component that (a) allows the circuit board assembly to be inserted into the supporting assembly to mate the first and second components of the connector assembly if the first keying feature is aligned with the second keying feature and (b) prevents contact between the first and second components of the connector assembly if the circuit board assembly lacks the first keying feature or has the first keying feature but is not aligned with the second keying feature.

Because the keying features do not require, in some embodiments, precise tolerances, production of the first keying feature and the second keying feature can be done separately from one another and even by different manufacturers. This can result in a distribution of work, production of the keying features by low cost processes, and other benefits known in the art associated with such processes.

After the circuit board assembly and support assemblies are manufactured with their respective keying features, an assembler may assemble a system that is protected by a combination of the first and second keying features (515). In other words, the support assembly with its second keying feature ensures that only circuit board assemblies with the first keying feature, and which have their first keying feature properly aligned with the second keying feature, can be inserted into the system to an extent that the connectors on the circuit assembly and in the support assembly, such as on a backplane, can make contact with one another. Such protection allows for low cost assembly of systems employing the first and second keying features, as described above in reference to the various embodiments. Once a system is assembled (step 520), the system may be deployed to its end use location, such as in a telecommunications network, optical communications network, or other operating environment.

While this invention has been particularly shown and described with references to preferred embodiments thereof, it will be understood by those skilled in the art that various changes in form and details may be made therein without departing from the scope of the invention encompassed by the appended claims.

What is claimed is:

1. A system for ensuring proper circuit board assembly insertion, comprising:

a circuit board assembly including (i) a first keying feature coupled to or integral with the circuit board assembly at a location other than at a faceplate and (ii) a first component of a connector assembly; and a support assembly configured to receive the circuit board assembly and including (i) a second component of the connector assembly and (ii) a second keying feature coupled to the support assembly at a location offset in a direction relative to the second component toward the first component as the first component travels toward the second component to mate with the second component that (a) allows the circuit board assembly to be inserted into the supporting assembly to mate the first and second components of the connector assembly if the first keying feature is aligned with the second keying feature and (b) prevents contact between the first and second components of the connector assembly if the circuit board assembly lacks the first keying feature or has the first keying feature but is not aligned with the second keying feature.

2. The system of claim 1 wherein the circuit board assembly includes a circuit board comprising the first keying feature.

3. The system of claim 1 wherein the circuit board assembly comprises:

at least one circuit board; and a circuit board subassembly to which the at least one circuit board is coupled, wherein the circuit board subassembly comprises the first keying feature.

4. The system of claim 1 wherein either (i) the first keying feature is a notch and the second keying feature is a tab, or (ii) the first keying feature is a tab and the second keying feature is a notch.

5. The system of claim 4 wherein the first keying feature is aligned parallel to or perpendicular to the second keying feature.

6. The system of claim 4 wherein the first component is located at an edge of the card assembly and the first keying feature is located at the same edge of the card assembly.

7. The system of claim 4 wherein the first component is located at an edge of the card assembly and the first keying feature is located at a different edge of the card assembly.

8. The system of claim 1 wherein either (i) the first keying feature is a slot and the second keying feature is a protrusion, or (ii) the first keying feature is a protrusion and the second keying feature is a slot.

9. The system of claim 1 wherein the first and second connector assemblies are absent keying features.

10. The system of claim 1 wherein the second keying feature is coupled to or integral with one of the following: a wall of the support assembly, a member of the support assembly, or, associated with the circuit board assembly at a location to the circuit board assembly, other than at a faceplate coupled a circuit board guide in the card assembly.

11. A method of ensuring proper circuit board assembly insertion, comprising:

enabling a circuit board assembly comprising (i) a first keying feature at a location other than at a faceplate and (ii) a first connector component to insert into a support assembly comprising a second keying feature and a second connector component to an extent the first and second connector components interconnect, the second keying feature coupled to the support assembly at a location offset in a direction relative to the second component toward the first component as the first component travels toward the second component to mate with the second component; and by the second keying feature, preventing circuit board assemblies that lack the first keying feature or have the first keying feature but are misaligned with the second keying feature from being inserted into the support assembly to an extent the first and second connector components contact each other.

12. The method of claim 11 wherein the first keying feature is integral in a shape of a circuit board of the circuit board assembly.

13. The method of claim 11 wherein the first keying feature is integral in a shape of a card tray of the circuit board assembly.

14. The method of claim 11 wherein the first keying feature is a notch or tab, and the second keying feature is a corresponding tab or notch.

15. The method of claim 14 wherein enabling the circuit board assembly to insert into the support assembly includes ensuring the first keying feature is configured to be either parallel or perpendicular to the second keying feature.

16. The method of claim 14 further comprising enabling the circuit board assembly to be inserted into the support assembly if at least a portion of the first keying feature is located at the leading edge of the circuit board assembly.

17. The method of claim 11 wherein the first keying feature includes either a slot in the circuit board assembly or a protrusion from the circuit board assembly, and the second keying feature includes either a slot in the support assembly or a protrusion from the support assembly.

18. The method of claim 11 wherein the first and second connector components are absent keying features.

19. A system for ensuring proper circuit board assembly insertion, comprising:

a circuit board assembly;

means for supporting the circuit board assembly; and first and second means for preventing contact between connector means associated with the circuit board assembly and connector means associated with the means for supporting the circuit board assembly, said first and second means located at a location other than at a faceplate, having at least a portion coupled to the support assembly at a location offset in a direction relative to the second component toward the connector means associated with circuit board assembly as the connector means travel toward one another to mate, and preventing contact if (i) the circuit board assembly lacks the first means for preventing contact and the means for supporting the circuit board assembly lacks the second means for preventing contact or (ii) the first means for preventing contact is not aligned with the second means for preventing contact.

20. A system for ensuring proper circuit board assembly insertion, comprising:

a circuit board assembly including (i) a first keying feature coupled to or integral with the circuit board assembly and (ii) a first component of a connector assembly; and a support assembly configured to receive the circuit board assembly and including (i) a second component of the connector assembly and (ii) a second keying feature located internal to the support assembly, coupled to the support assembly at a location offset in a direction relative to the second component toward the first component as the first component travels toward the second component to mate with the second component and that (a) allows the circuit board assembly to be inserted into the supporting assembly to mate the first and second components of the connector assembly if the first keying feature is aligned with the second keying feature and (b) prevents contact between the first and second components of the connector assembly if the circuit board assembly lacks the first keying feature or has the first keying feature but is not aligned with the second keying feature.

21. A method of ensuring proper circuit board assembly insertion, comprising:

enabling a circuit board assembly comprising a first keying feature and a first connector component to insert into a support assembly comprising (i) a second keying feature located internal to the support assembly and (ii) a second connector component to an extent the first and second connector components interconnect, the second keying feature coupled to the support assembly at a location offset in a direction relative to the second component toward the first component as the first component travels toward the second component to mate with the second component; and by the second keying feature, preventing circuit board assemblies that lack the first keying feature or have the first keying feature but are misaligned with the second keying feature from being inserted into the support assembly to an extent the first and second connector components contact each other.

22. The system of claim 1 wherein the second keying feature is coupled to or integral with a given wall of the support assembly, the second component of the connector assembly being located at a wall of the support assembly other than the given wall.

* * * * *